US005545306A

United States Patent [19]

Shimamune et al.

[11] Patent Number: 5,545,306

[45] Date of Patent: Aug. 13, 1996

[54] METHOD OF PRODUCING AN ELECTROLYTIC ELECTRODE

[75] Inventors: Takayuki Shimamune; Yasuo Nakajima, both of Tokyo, Japan

[73] Assignee: Permelec Electrode Co. Ltd., Kanagawa, Japan

[21] Appl. No.: 353,973

[22] Filed: Dec. 6, 1994

Related U.S. Application Data

[62] Division of Ser. No. 92,437, Jul. 14, 1993, Pat. No. 5,391, 280.

[30] Foreign Application Priority Data

Jul. 17, 1992 [JP] Japan ..... 4-213481

[51] Int. Cl.$^6$ ..... C25D 15/00

[52] U.S. Cl. ..... 205/109; 205/171

[58] Field of Search ..... 205/109, 171

[56] References Cited

U.S. PATENT DOCUMENTS

| | | | |
|---|---|---|---|
| 3,616,323 | 10/1971 | Covitz | 204/290 R |
| 3,661,730 | 5/1972 | Nishahara | 205/253 |
| 4,064,035 | 12/1977 | Fukasawa | 204/290 R |
| 4,131,515 | 12/1978 | Ruben | 204/2.1 |
| 4,510,034 | 4/1985 | Ohshima et al. | 204/290 F |
| 4,822,459 | 4/1989 | Ueda et al. | 205/109 |

*Primary Examiner*—Kathryn Gorgos
*Attorney, Agent, or Firm*—Sughrue, Mion, Zinn, Macpeak & Seas

[57] ABSTRACT

The present invention relates to a method of producing an electrolytic electrode containing the following steps: forming a lead plating layer on the surface of a metallic core material by using a lead electrolytic plating bath, where the metallic core material is the cathode; forming an α-lead dioxide layer on the lead plating layer by electrolysis using an alkaline bath containing a lead ion and using the core material as the anode; and forming a β-lead dioxide layer on the α-lead dioxide layer by electrolysis using an aqueous lead nitrate solution and using the core material as the anode. The electrolytic electrode produced by the foregoing method is capable of electrolysis in an aqueous solution, in particular, in an aqueous corrosive solution containing fluorine ions.

5 Claims, No Drawings

METHOD OF PRODUCING AN ELECTROLYTIC ELECTRODE

This is a divisional of application Ser. No. 08/092,437 filed Jul. 14, 1993, now U.S. Pat. No. 5,391,280.

FIELD OF THE INVENTION

The present invention relates to an electrolytic electrode capable of electrolysis in an aqueous solution, in particular, in an aqueous corrosive solution containing fluorine ions, and also to a method of producing the electrolytic electrode.

BACKGROUND OF THE INVENTION

Lead dioxide is a compound having a metallic electric conductivity. Since lead has excellent durability, lead dioxide is, in particular, very stable at an anodic polarization in an acidic bath and, furthermore, can be relatively easily produced by an electrodeposition method, etc. Lead dioxide has been widely used, for example, as an industrial electrolytic anode for the production of explosives such as peroxides, perchlorates, etc.; raw materials for oxidizing agents; syntheses of organic compounds; water treatment; etc.

By utilizing these characteristics, block lead dioxide electrodes were practically used in the 1940's. The electrode being used was formed by cutting a pot-form iron having a lead dioxide layer on the inside surface thereof by electrodeposition. However, the production thereof was very troublesome, and the production yield was bad; further, such an electrode had a brittleness characteristic of ceramics, and the specific gravity thereof was about 9, which was larger than that of iron, whereby the electrode was difficult to handle. Hence, the usable ranges of the electrodes were limited.

However, since titanium having an excellent corrosive resistance to anodic polarization in an acidic solution has been commercially used since the 1950's, the cost of titanium has lowered, and titanium is now used more in the chemical industries. For example, a light-weight and durable lead dioxide electrode composed of the combination of titanium and lead dioxide has been produced, that is, an electrode composed of a titanium core having electrodeposited lead dioxide on the surface thereof. However, in the electrode, the interface between titanium as the core material and the lead dioxide layer was passivated by the strong oxidative power of lead dioxide, which sometimes resulted in making the passage of electric current impossible. Since electrically conductive titanium could not be used as the electrically conductive member, the lead dioxide layer itself was used as the electrically conductive member at first. Thereafter, by spot-like welding platinum onto the surface of titanium to form an anchor, the electric conductivity was ensured.

Also, it became possible to obtain a good electric conductivity by applying a platinum plating to the whole surface of titanium. However, this resulted in cracking the lead dioxide layer (and if a part of the lead dioxide layer was broken, platinum having a high activity to ordinary oxygen generation caused a reaction which peeled-off the lead dioxide layer).

The inventors previously solved the foregoing passivation problem by using semiconductive oxides of valve metals each having a different valent number. On the other hand, since the electrodeposition thickness of the lead dioxide layer on the surface of the core material was from 0.1 to 1 mm, which was thicker than the thickness of ordinary plating, the problem of peeling-off the coating by the electrodeposition strain could not be avoided. However, the problem is being solved by laminating or mixing α-lead dioxide and β-lead dioxide or by variously selecting other electrodepositing conditions. However, from the viewpoint of improving the corrosion resistance of lead dioxide, increasing the electrodeposition strain is desirable and, hence, corrosion resisting particles are dispersed in the β-lead dioxide layer, as disclosed in, for example, U.S. Pat. No. 4,822,459.

The lead dioxide electrode developed through the developing steps described above was considered to be an almost completed technique for an ordinary electrolytic reaction but it was experienced that when the lead dioxide electrode was used in a fluoride-containing electrolyte containing fluorine ions or fluoride ions for a long period of time, hair cracks formed even though they were very slight and the electrolyte permeated through the cracks into the titanium portion of the ground, whereby corrosion resisting titanium was dissolved out.

As a countermeasure for the fluoride-containing electrolyte, it has been proposed that iron is used as the core material in place of titanium, an intermediate coating is strongly applied thereto, and a lead dioxide layer is formed on the surface thereof to constitute an electrode. However, once cracks form in such an electrode, the electrode is not sufficiently satisfactory since the corrosion resistance of iron as the core material is far inferior to that of titanium.

As described above, various investigations have been made on lead dioxide electrodes and various solving methods have been proposed but a lead dioxide electrode having a sufficient corrosion resistance and practical use to a fluoride-containing electrolyte, which is frequently used and is considered to be increasingly used hereafter, has not yet been realized.

SUMMARY OF THE INVENTION

The present invention solves the problems described above.

Furthermore, an object of the present invention is to provide an electrolytic electrode giving a sufficient durability during electrolysis using various kinds of solutions, in particular, an aqueous solution containing fluorine ions or fluoride ions, and also to a method of producing the electrode.

Thus, according to an aspect of the present invention, there is provided an electrolytic electrode comprising a metallic core material, a lead plating layer formed on the surface of the core material, an α-lead dioxide layer formed on the surface of the lead plating layer, and a β-lead dioxide layer formed on the surface of the α-lead dioxide layer.

Also, according to another aspect of the present invention, there is provided a method of producing the electrolytic electrode.

That is, according to the first production method of the present invention, there is provided a method of producing an electrolytic electrode, which comprises carrying out lead plating in a lead electrolytic plating bath using a metallic core material as the cathode to form a lead plating layer on the core material, carrying out an electrolysis in an alkali bath containing a lead ion using the core material as the anode to form an α-lead dioxide layer on the surface of the lead plating layer on the core material, and carrying out an electrolysis in an aqueous lead nitrate solution using the core material as the anode to form a β-lead dioxide layer on the α-lead dioxide layer.

Also, according to the second production method of the present invention, there is provided a method of producing an electrolytic electrode, which comprises carrying out lead plating in a lead eletrolyte plating bath using a metallic core material as the cathode to form a lead plating layer on the core material, carrying out an electrolysis in an aqueous diluted sulfuric acid solution using the core material having the lead plating layer as the anode to form an α-lead dioxide layer, and then forming a β-lead dioxide layer on the α-lead dioxide layer on the surface of the core material.

DETAILED DESCRIPTION OF THE INVENTION

The present invention is described in detail below.

Since in the electrolytic electrode of the present invention, the core material is coated with two lead dioxide layers and a lead plating layer, even when cracks form in the lead dioxide layers during electrolysis, the electrolyte scarecely reaches the core material and, thus, when the electrode is used, in particular, in a fluoride-containing electrolyte showing a high corrosive property, the function of the electrode is maintained for a long period of time.

The electrode of the present invention can be produced as follows.

The core material of the electrode of the present invention may have a physical form-keeping function and a function as an electrically conductive member. There is no particular restriction on the core material if the material has these functions, and iron, stainless steel, nickel, etc., can be used. However, in the case of partially peeling-off the lead dioxide layers and the lead plating layer and for minimizing the damage thereof, it is preferred to use a valve metal which is very stable at an anodic polarization. Preferred examples of these valve metals include titanium or a titanium alloy (which are easily handled and are relatively inexpensive). In addition, the core material may be in various forms such as a tabular form, a perforated form, an expand mesh, etc.

It is preferable to apply a sufficient ground treatment to the core material. Examples of the ground treatment include a method of increasing the surface area by a blast treatment, a method of activating the surface by acid pickling, a method of carrying out a cathodic polarization in an electrolyte such as an aqueous sulfuric acid solution, etc., to generate a hydrogen gas from the surface of a substrate to carry out surface washing and carrying out an activation by a hydride partially formed by the hydrogen gas, etc.

In the case of using a valve metal, particularly, titanium as the core material, for improving the affinity of the core material and the lead plating layer and, further, for improving the corrosion resistance of the core material, it is preferred to form an electrically conductive oxide on the surface of the core material. As a method of forming the electrically conductive oxide, there are various methods such as a thermal oxidation method, etc., but in the case of using titanium or a titanium alloy as the core material, for forming the oxides with valve metals each having a different valent number, it is preferred to coat the core surface with an aqueous hydrochloric acid solution containing titanium or tantalum and thermally decomposing the coated layer in an oxygen-containing atmosphere at a temperature of from 450° to 600° C. to form the oxide.

Also, in the case of using tantalum or niobium as the core material, a very thin oxide layer is usually formed on the surface by air oxidation without applying a surface treatment such as a thermal oxidation method, etc., and the oxide layer functions as a very good stabilizing layer. If necessary, after coating an alcohol solution of titanium-niobium or titanium-tantalum on the cleaned surface, the coated layer is thermally decomposed in air at a temperature of from 350° to 500° C. or in an atmosphere having an oxygen concentration lowered to 15% or lower at a temperature of from 400° to 600° C., whereby an oxide layer can be formed on the surface. In addition, when the core material is an iron family metal belonging to group VIII of the periodic table, it is usually unnecessary to form the oxide layer on the surface of the core material by the foregoing procedure but if the formation of the oxide layer is intended, the core material may be heated in air to a temperature of from 500° to 800° C. without using the coating liquid.

Then, a lead plating layer is formed on the core material with or without the surface treatment as described above.

There is no particular restriction on the plating condition if a plating layer which is precise and has no perforations is formed. But for avoiding the formation of the perforations, a plating method having a high current efficiency is desirable and the use of a so-called borofluoride bath, i.e., a plating bath containing lead borofluoride as the main component is particularly desirable. The typical plating condition of the borofluoride bath is as follows, and the current efficiency is generally 95% or higher.

Lead Borofluoride 200 g/liter

Ammonium Chloride 50 g/liter

Ammonium Borofluoride 50 g/liter pH 3.5 to 4

Temperature 25° to 40° C.

1 to 5 A/dm$^2$

Current Density

As another method of plating lead borofluoride, an immersion plating method wherein the core material is immersed in molten lead and thereafter drawn up can be used. However, since it is not easy to uniformly form the plating layer on the whole surface of the core material by this method, it must be noticed whether the plating layer is completely formed on the whole surface of the core material.

In the present invention, it is preferred for the thickness of the lead plating layer to be at least 5 μm such that the core material is almost completely coated. Also, if the thickness of the plating layer is over 100 μm, the occurrence of an electrodeposition strain becomes large and there occurs a problem in the maintenance of the lead dioxide layer described below. Thus, it is preferred for the thickness of the lead plating layer to be from 5 to 100 μm.

Then, a lead dioxide coating is formed on the surface of the lead plating layer. In this case, the lead dioxide layer may be directly formed on the surface of the lead plating layer but if the lead dioxide layer formed is partially peeled off to expose the lead plating layer, since lead is more active than lead dioxide, electrolysis occurs at the surface of the lead and the lead is consequently consumed to expose the core material and shorten the life of the electrode. Thus, it is preferred to restrain the activity of lead in the lead plating layer. For this purpose, porous lead sulfate may be formed on the surface of lead by immersing the core material in an aqueous solution of from 5 to 30% sulfuric acid, and preferably from 10 to 20% sulfuric acid for from 5 to 10 minutes, whereby the surface of lead can be partially blocked to restrain the apparent activity of lead.

If a β-lead dioxide layer is directly formed on the core material, the adhesion and uniformity of the β-lead dioxide layer and the lead plating layer are inferior and hence in the present invention, an α-lead dioxide layer is formed between them. The α-lead dioxide layer can be formed on the core material by dissolving a lead monodioxide powder (litharge) in an aqueous solution of about 20% sodium hydroxide until saturation (30 to 40 g/liter) and carrying out electrolysis using the solution as an electrolytic bath and using the core material as the anode at a temperature of from 20° to 50° C. and at a current density of from 0.1 to 10 A/dm$^2$. In another method of forming the α-lead dioxide layer, by electrolyzing using the sulfuric acid bath for forming lead sulfate described above as an electrolyte and using the core material having formed thereon and the lead plating layer as the anode at a current density of about from 1 to 10 A/dm$^2$, the surface portion of the foregoing lead plating layer is oxidized to form the α-lead dioxide layer. Usually, β-lead dioxide is formed in the acid, however, almost complete α-lead dioxide is obtained by this method although the reason has not yet been clarified.

On the surface of the α-lead dioxide layer is further formed a β-lead dioxide layer. There is no particular restriction on the method of forming the β-lead dioxide layer. As a result, any conventional method can be used. For example, by electrolyzing using a lead nitrate bath having a concentration of at least 200 g/liter as an elecrolyte bath and, as the anode, using the core material having formed thereon the α-lead dioxide layer at a temperature of from 50° to 70° C. and at a current density of from 1 to 10 A/dm$^2$, a β-lead dioxide layer is formed on the α-lead dioxide layer on the core material, whereby the desired electrode for electrolysis can be obtained.

The electrode thus produced can perform a stable electrolysis for a long period of time in not only a common electrolyte but also a corrosive elecrolyte, and the electrode produced as described above can effectively be used for a long period of time even in a fluoride-containing electrolyte regardless of the concentration and the kind of fluoride ions. However, the above-described condition greatly increases the electrodeposition strain and, thus, for the stabilization of the foregoing β-lead dioxide layer, by dispersing a stable powder of ceramics such as tantalum oxide, etc., or a fluorine resin, etc., or by dispersing fibers in the plating bath, the apparent electrodeposition strain is removed to stabilize the β-lead dioxide layer, as disclosed in, for example, U.S. Pat. No. 4,822,459.

The following examples are intended to illustrate the present invention but not to limit it in any way. Unless otherwise indicated, all parts, percents, ratios and the like are by weight.

Example 1

The surface of a core material of expand mesh made of titanium having a thickness of 1.5 mm was roughened by blasting with iron grids having the largest particle size of 1.2 mm. After activating the surface of the core material by acid pickling in 25% sulfuric acid at 80° C. for 2 hours, a lead layer having an average thickness of 10 μm was formed on the surface of the core material using a commercially available lead borofluoride series lead plating bath at a temperature of 40° C. The current efficiency calculated from the increase of the weight was 95%.

The core material having formed thereon the lead layer was immersed in 20% sulfuric acid at 40° C. for 30 minutes and, thereafter, electrolysis was carried out using the core material as the anode at a current density of 4 A/dm$^2$ for 2 hours. Thus, a thin α-lead dioxide layer was formed on the surface of the core material.

Then, electrolysis was carried out using the core material having formed thereon the thin layer of α-lead dioxide as the anode and an aqueous solution of 800 g/liter of lead nitrate having suspended therein 1% a tantalum oxide powder having particle sizes of from 0.1 to 10 μm at a temperature of 65° C. and a current density of 4 A/dm$^2$ for 4 hours, whereby a β-lead dioxide layer having dispersed therein the tantalum oxide powder was formed on the thin layer of α-lead dioxide. The particle sizes of the particles of the lead dioxide layer were apparently about 200 μm.

When electrolysis was carried out using the electrode thus prepared as the anode in an aqueous sulfuric acid solution containing 2% hydrogen fluoride at a current density of 100 A/dm$^2$, after 3,000 hours, one crack having a length of 5 mm and a width of 0.1 mm or less formed on a part of the lead dioxide layer but the electrode could endure the electrolyte an additional 9,500 hours. On the other hand, when an electrode was prepared by forming a lead oxide layer after forming a platinum plating layer as an electrically conductive supporting layer (of about 1 μm in thickness on the titanium core material as above) in place of the lead plating layer, the elecrode cracked after about 3,000 hours and, thereafter, the electrolysis could be continued for about 4,000 hours but the titanium core material began to dissolve out from the cracked portions, thereby the electrode was broken until the electrode was deformed.

Example 2

The surface of a titaniumcore material prepared by the same manner as in Example 1 was coated with an aqueous solution of titanium tetrachloride and tantalum pentachloride containing titanium and tantalum at a ratio of 90/10 and burned at 550° C. By repeating the coating and burning steps three times, a core material was prepared and a lead layer was formed on the surface thereof by the same manner as in Example 1. Then, electrolysis was carried out in an electrolytic bath at 40° C. prepared by saturating an aqueous 25% sodium hydroxide solution with litharge (PbO) using the core material as the anode at a current density of 1 A/dm$^2$ for 2 hours to form an α-lead dioxide layer on the surface thereof. Then, by following the same procedure as in Example 1, except that the tantalum powder was not dispersed, a β-lead dioxide layer was formed on the α-lead dioxide layer.

When the evaluation of the electrolysis was carried out on the electrode under the same condition as in Example 1, cracks formed after 2,000 hours but the electrode could be used for electrolysis over 8,000 hours.

Example 3

A perforated plate (diameter 2 mm, pitch 3 mm) of SUS 316, used as a core material, was subjected to a blasting treatment and, after acid pickling the core material, the core material was heated to 600° C. in air for 2 hours to form an oxide layer on the surface thereof. Thereafter, the lead layer and the lead dioxide layers were formed thereon as in Example 1 to provide an electrode.

When the evaluation of the electrolysis was carried out on the electrode by the same manner as in Example 1, the electrode life at a current density of 50 A/dm$^2$ was 9,300 hours.

In addition, by comparison, a platinum plating layer of 1 μm was formed on the surface of the core material without forming the lead layer and further an α-lead dioxide layer and a β-lead dioxide layer were formed on the core material to provide an electrode.

When the electrode was used for electrolysis as above, cracks formed after about 2,500 hours and, almost at the same time, the component of the core material began to dissolve out to color the electrolyte brown, and the electrolysis could not be continued.

Effect of the Invention

The electrolytic electrode of the present invention is composed of a metallic core material, lead plating layer formed on the surface of the core material, an α-lead dioxide layer formed on the lead plating layer, and a β-lead dioxide layer formed on the α-lead dioxide layer.

In the electrolytic electrode having the foregoing construction, even when cracks form in the uppermost β-lead dioxide layer, the permeation of an electrolyte into the core material is prevented by the α-lead dioxide layer, which essentially functions to improve the adhesion and uniformity with the β-lead dioxide layer, and the inside lead plating layer, whereby the life of the electrode is certainly prolonged.

The lead plating layer formed between the α-lead dioxide layer and the core material has a higher activity than that of the lead dioxide layers and if cracks form in both lead dioxide layers, it sometimes happens that the lead plating layer is brought into contact with an electrolyte and reacts with the electrolyte to be dissolved out, whereby the core material is exposed to shorten the life of the electrode. For preventing the occurrence of this disadvantageous effect, a porous lead sulfate layer may be formed between the lead plating layer and the α-lead dioxide layer to partially block the lead plating layer and further prevent the contact of the lead plating layer with the electrolyte, whereby shortening of the life of the electrode may be restrained.

As described above, the electrolytic electrode of the present invention is particularly useful as an electrode in a fluoride-containing electrolyte. However, even in the present invention, the electrodeposition strain is liable to become large. Therefore, to prevent the occurrence of the increase of the electrodeposition strain, a ceramic powder and/or a fluorine resin powder may be dispersed in the β-lead dioxide layer to stabilize the β-lead dioxide layer.

It is desirable if the thickness of the lead plating layer formed is from 5 to 100 μm, the core material is completely covered by the lead plating layer, and the occurrence of the electrodeposition strain is reduced, whereby the lead dioxide layers are maintained.

Also, in the production method for an electrolytic electrode according to the present invention, a lead plating layer is formed on a metallic core material by carrying out a lead plating in a lead electrolytic plating bath using the core material as the cathode, an α-lead dioxide layer is formed on the lead plating layer by carrying out electrolysis in an alkali bath containing a lead ion using the core material as the anode, and then a β-lead dioxide layer is formed on the α-lead dioxide layer by carring out electrolysis in an aqueous lead nitrate solution using the core material as the anode.

In the electrolytic electrode composed of the lead dioxide layers produced by the above-described method, even when cracks form in the outermost β-lead dioxide layer, the permeation of an electolyte into the core material is prevented by the α-lead dioxide layer, whereby the life of the electrode is prolonged.

Furthermore, a lead borofluoride bath is used as the lead plating bath, the current efficiency is increased, and a lead plating layer having almost no perforations can be formed.

Also, as described above, in the electrolytic electrode of the present invention, it is preferred to stabilize the β-lead dioxide layer by dispersing a ceramic powder and/or a fluorine resin powder in the β-lead dioxide layer, and for producing such an electrode, a ceramic powder and/or a fluorine resin powder may be dispersed in the foregoing aqueous solution of lead nitrate which is used for forming the β-lead dioxide layer.

In another production method for the electrolytic electrode according to the present invention, a lead plating layer is formed on the core material by the same manner as described above. Then, the core material having the lead plating layer is immersed in a diluted sulfuric acid solution, electrolysis is carried out using the core material as the anode to form an α-lead dioxide layer on the lead plating layer, and then a β-lead dioxide layer is formed on the α-lead dioxide layer.

By one method, an electrolytic electrode composed of lead dioxide layers is produced and, in particular, has a high durability to a fluoride-containing electrolyte. Furthermore, in another method, since the core material is immersed in the diluted sulfuric acid solution the surface layer of the lead plating layer is converted into a lead sulfate layer which protects the lead plating layer and formation of the α-lead dioxide layer can be continued in the same sulfuric acid bath. Therefore, this method is very convenient.

While the invention has been described in detail and with reference to specific embodiments thereof, it will be apparent to are skilled in the art that various changes and modifications can be made without departing from the spirit and scope thereof.

What is claimed is:

1. A method of producing an electrolytic electrode, which comprises the steps of:

forming a lead plating layer on a surface of a metallic core material by using a lead electrolytic plating bath where the metallic core material is a cathode;

forming an α-lead dioxide layer on the lead plating layer by electrolysis using an alkaline bath containing a lead ion and using the core material as an anode; and forming a β-lead dioxide layer on the α-lead dioxide layer by electrolysis using an aqueous lead nitrate solution and using the core material as an anode.

2. The method of claim 1, wherein the lead electrolytic plating bath is a lead borofluoride bath.

3. The method of claim 1, wherein a ceramic powder, a fluorine resin powder, or a mixture thereof is dispersed in the aqueous lead nitrate solution.

4. The method of claim 1, wherein the metallic core metal comprises a valve metal.

5. The method of claim 1, wherein the metallic core material has an electrically conductive oxide surface.

* * * * *